United States Patent [19]

Schmidt

[11] 4,133,395

[45] Jan. 9, 1979

[54] EARTH BORING ASSEMBLY WITH DRAG PIPE

[76] Inventor: Paul Schmidt, Reiherstrasse, 5940 Lennestadt, Germany

[21] Appl. No.: 803,849

[22] Filed: Jun. 6, 1977

[30] Foreign Application Priority Data

Jul. 9, 1976 [DE] Fed. Rep. of Germany ..... 2630891

[51] Int. Cl.[2] ..... E21B 11/02

[52] U.S. Cl. ..... 175/22; 175/257; 175/321; 285/307; 403/369; 403/371

[58] Field of Search ..... 175/22, 23, 19, 257, 175/321; 285/307, 321, 308; 403/369, 371; 279/28

[56] References Cited

U.S. PATENT DOCUMENTS

| | | | |
|---|---|---|---|
| 785,105 | 3/1905 | Johnston | 279/28 |
| 2,364,813 | 12/1944 | Pixler | 279/28 |
| 3,127,943 | 4/1964 | Mori | 175/257 |
| 3,708,023 | 1/1973 | Nazarov | 173/137 |
| 3,773,360 | 11/1973 | Timbers | 285/307 |

*Primary Examiner*—Ernest R. Purser
*Assistant Examiner*—William F. Pate, III
*Attorney, Agent, or Firm*—Toren, McGeady and Stanger

[57] ABSTRACT

An earth boring assembly is provided with a hammer member at its leading end for impacting through an earth formation to form a boring therein. An expander cone is attached rearwardly of the hammer to expand the boring which has been formed by the hammer and drag pipes are connected to follow the hammer into the boring. Clamping means interposed between the expander cone and the drag pipe operate to automatically effect frictional locking engagement between the hammer and the drag pipe when the expander cone and the drag pipe are moved toward each other and to automatically release the frictional engagement when the members are moved away from each other. The clamping means may specifically comprise an annular slotted ring having wedge-shaped outer surfaces by means of which the ring is caused to become clamped and released about the hammer.

12 Claims, 4 Drawing Figures

EARTH BORING ASSEMBLY WITH DRAG PIPE

BACKGROUND OF THE INVENTION

The present invention relates generally to earth boring apparatus and more specifically to a device for interconnecting an earth boring hammer provided with an expander cone together with a drag or follower pipe.

Devices of the type to which the present invention relates have been utilized to produce trial borings, land ties and ground injections whereby the ground or earth is displaced by an earth displacement boring hammer with the borings thus produced being propped or stabilized by follower or drag pipes which are moved into the boring behind the earth displacement hammer and which support the earth surrounding the boring. Lateral displacement of the earth within which the boring is to be made is effected specifically by an expander cone which follows the hammer into the boring. The expander cone is normally located about the boring hammer and is dragged therewith into the boring. Normally, the expander cone is prevented from moving rearwardly of the hammer beyond a specific degree by means of an engagement which is provided between the cone and the hammer so that as the hammer moves downwardly it may abut a shoulder or other structural part of the cone and move the cone therewith into the boring. Thus, the expander cone will normally operate as a collar about the hammer.

The rear end of the expander cone may be connected, for example, with the follower or drag pipe which may consist of steel or plastic material. Since the inside diameter of the drag pipe is greater than the diameter or collar of the earth displacement hammer serving to prop the expander cone, the displacement or boring hammer may be withdrawn through the drag pipe after a predetermined stage of the boring operation so that the drag pipe may be subsequently utilized for further introduction of materials into the boring or may also be withdrawn from the boring.

Generally, a plurality of drag pipes may be connected to the initial drag pipe which is attached to the displacement hammer. In the event that the load of the plurality of drag pipes being inserted into the bore becomes too heavy or if the friction between the drag pipes and the surrounding earth becomes great, the displacement hammer may no longer be capable of pulling or dragging the expander cone and the drag pipes into the boring. In the event that this occurs, it is generally necessary to apply to the outer end of the drag pipes a force, in addition to the force applied to the boring hammer, in order to drive the drag pipes and the expander cone into the boring. Generally, it has been the procedure to apply such a force by means of a hydraulic press having a hollow piston and self-gripping tongs.

Although by this method the drag pipes and the expander cone are driven into the boring in a generally satisfactory manner, in order to overcome excessive friction between the drag pipes and the earth, this type of procedure for driving the apparatus into the ground gives rise to certain disadvantages inasmuch as the boring hammer itself is usually not firmly supported toward the rear at the point where a connection is made with the leading drag pipe. This usually is necessary and advantageous in order to achieve an optimum percussive effect upon the boring hammer. The support in the drag pipe is not available inasmuch as there must be no projecting stop means or other similar devices so as to avoid that the collar of the displacement or boring hammer would strike against such a stop when the hammer is retracted otherwise it could no longer be brought rearwardly of the boring.

Thus, the object of the invention is to provide a device for suitably connecting a boring or earth displacement hammer operating with an expander cone with the drag or follower pipes which must be utilized, the device operating to insure with a simple and uncomplicated structural arrangement the automatic connection and disconnection between the boring hammer and the drag pipe while at the same time operating to support the boring hammer toward the rear thereof.

SUMMARY OF THE INVENTION

Briefly, the present invention may be described as an earth boring assembly comprising hammer means for impacting through an earth formation to form a boring therein, expander cone means attached rearwardly of the hammer means to expand the boring, and drag pipe means connected to follow the hammer means into the boring. Clamping means are interposed between the expander cone means and the drag pipe means, with the clamping means being operative to automatically effect frictional locking engagement between the hammer means and the drag pipe means when the expander cone means and the drag pipe means are moved toward each other and to automatically release said frictional engagement when the expander cone means and the drag pipe means are moved away from each other.

The clamping means may be in the form of an annular longitudinally slotted clamping member having wedge-shaped surfaces on its outer circumference. As the drag pipe means is moved toward the hammer means, with the expander cone means and the drag pipe means consequently moving together, engagement of a mating surface connected with the drag pipe means against the wedge-shaped surface of the clamping ring will cause the ring to move into tight engagement about the hammer means so that any further force applied to the drag pipe means will be transmitted through the frictional engagement of the clamping ring to the hammer means.

Thus, the problems normally encountered in prior art arrangements are overcome by the device according to the present invention inasmuch as the boring hammer is automatically retained in frictional engagement with the drag pipe means during axial movement of the expander cone means and the drag pipe means toward each other. The frictional engagement is automatically disconnected when the members are moving apart. As soon as the shearing force on the drag pipe is terminated, the connection between the boring hammer and the drag pipe is automatically interrupted so that the boring hammer may be free to be drawn backwardly through the interior of the drag pipe means in a protected manner, should this become necessary.

In a preferred embodiment of the invention, the clamping means is formed as a clamping ring having an elongated slot encircling the boring hammer. This provides the further advantage that the objects of the invention may be achieved by a rather simple construction of the parts, with the elements of the assembly being easy to produce and easy to assemble, particularly because of the slotted design of the clamping ring.

The clamping ring is preferably formed with its outer surface in a wedge-shaped configuration and more specifically as a double-wedge ring. Furthermore, the ring may be formed of resilient material. When the drag pipe and the expander cone means move toward each other, the double-wedge clamping ring may be very easily brought into its clamping position and it will automatically spring back into its original starting position when the aforementioned parts move away from each other, as would occur when the shearing or driving force on the drag pipe is terminated. The clamping ring is preferably formed with a cylindrical inner surface and a pair of outer inclined surfaces extending divergently from each other from the center of the clamping ring.

In a specific construction of the invention, the expander cone is formed with interior shoulder means which are engaged by shoulder means of the hammer so that the expander cone is driven into the borings together with the hammer. The drag pipe is threadedly in engagement with a bush and a bayonet-type lock is formed between the bush and the expander cone so that the drag pipe means and the bush may move relative to the expander cone to a limited degree, with relative motion beyond such limited degree in two directions being prevented by the bayonet lock so that, beyond this limited degree of motion, the expander cone will be driven forwardly or rearwardly by movement of the drag pipe means. Thus, when the expander cone stops moving in a forward direction, the drag pipe means and the bush are capable of forward-direction movement relative to the expander cone whereby the wedge surface of the clamping ring is placed in engagement between inner surfaces of the expander cone and the bush in order to squeeze the clamping ring about the hammer means.

Thus, in the invention, the clamping ring is arranged between the expander cone and the bush which is secured to the drag pipe and which is displacable on the expander cone. The ends of the expander cone and of the bush facing each other are, respectively, preferably provided with contact surfaces corresponding to the outer inclined surfaces of the clamping ring which operate as mating surfaces.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
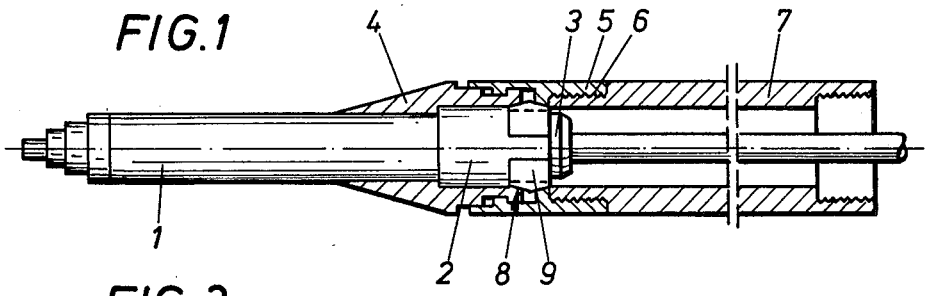
FIG. 1 is a longitudinal sectional view taken through an earth boring assembly in accordance with the present invention showing the clamping means of the invention in the opened or disconnected positions.
Figure 2:
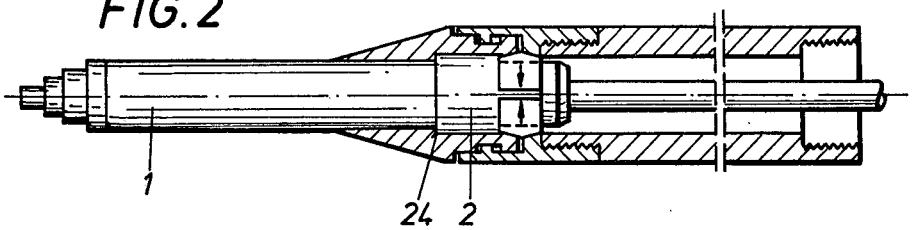
FIG. 2 is a corresponding longitudinal sectional view showing the clamping means in the clamped position.

Referring now to the drawings wherein like reference numerals are used to designate similar parts throughout the various figures thereof, the assembly of the invention is shown as comprising an earth displacement or boring hammer 1 having at its rear end a collar 2 and a rear edge bevel 3. An expander cone 4 is provided on the collar 2 with the expander cone being brought into position over the leading edge of the hammer 1.

A bush 5 is threadedly engaged by screw means 6 with a drag or follower pipe 7. The bush 5 is displaceably engaged with the expander cone 4, in a manner which will be more fully described hereinafter.

Inwardly of the expander cone 4 and the bush 5, in a region between the junction thereof, there is arranged a clamping device 8 which consists of an annular longitudinally slotted clamping ring 9.

Figure 3:
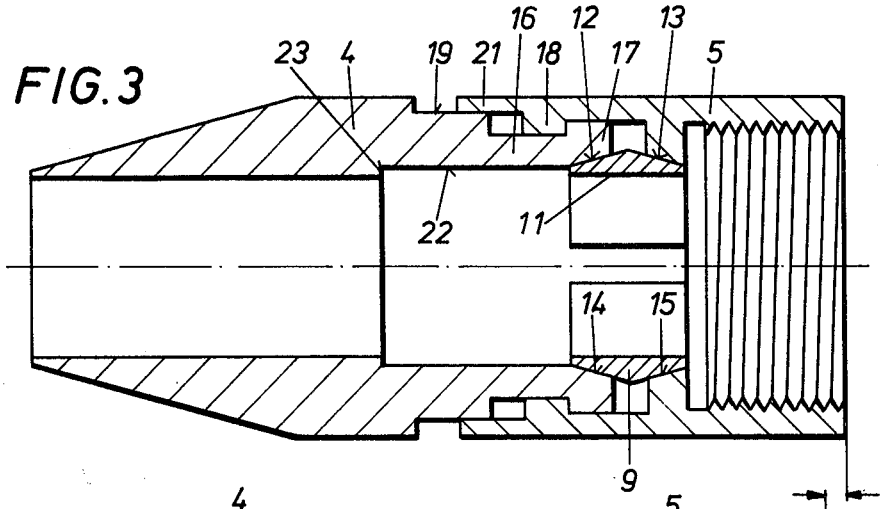
FIGS. 3 and 4 are each sectional views showing in greater detail certain parts of the assembly with the clamping means being shown, respectively, in the opened and closed position.
Figure 4:
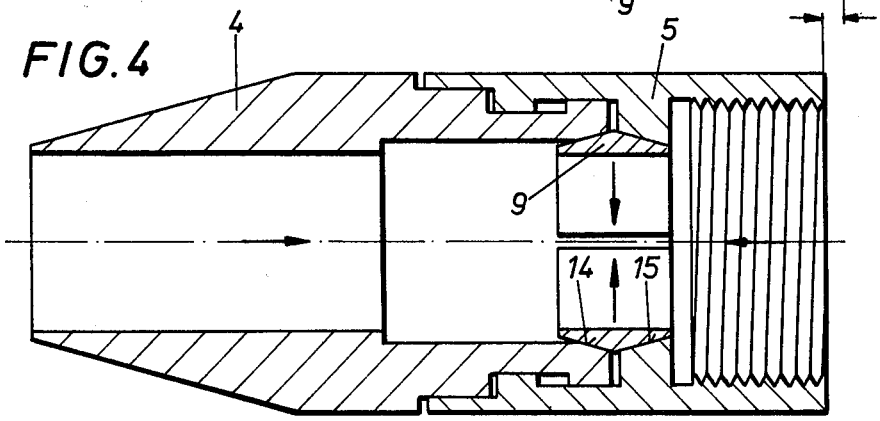

The clamping arrangement of the present invention, as well as the structure of the expander cone 4 and the bush 5, may be seen in greater detail in FIGS. 3 and 4. The clamping ring 9, as shown therein, includes a cylindrical inner surface 11 as well as a pair of outer inclined surfaces 12, 13 which taper away from each other from the center of the ring 9 in a direction radially inwardly of the assembly. The surfaces 12 and 13 thereby essentially comprise wedge means whereby the clamping ring may be tightened about the hammer 1 and the ring 9 is thus designed as a double-wedge ring. At the ends of the expander cone 4 and the bush 5 facing each other there are arranged contact surfaces corresponding with the inclined surfaces 12, 13 of the clamping ring 9 and arranged to act in a mating relationship therewith.

The rear part of the expander cone 4 facing the bush 5 is designed to form a sleeve 16. In the sleeve 16 of the expander cone 4 there is arranged an outwardly projecting stop 17 which cooperates with an inwardly projecting stop 18 on the bush 5. Furthermore, a stepped circumferential surface 19 is provided on the sleeve 16 upon which there is displaceably mounted an outer part 21 of the bush 5. All of the parts are designed in the manner of a bayonet lock so that some relative axial movement between the bush 5, having the drag pipe 7 fixedly attached thereto, and the expander cone 4, which is connected with the boring hammer 1, may be permitted. The relative displacement which is permitted between the bush 5 and the drag pipe 7, on the one hand, and the cone 4 and the hammer 1, on the other hand, is depicted in FIGS. 3 and 4. In FIG. 3, the parts have moved away from each other and the bush 5 is at its point of maximum displacement in one direction relative to the cone 4. In FIG. 4, the bush 5 and the expander cone 4 have moved toward the opposite limit of their relative displacement taken in a direction toward each other.

In the sleeve 16 there is also arranged an annular recess 22 designed as a blind bore which forms a stop edge 23 inside the expander cone 4 upon which there bears a front ring shoulder 24 of collar 2 of the displacement or boring hammer 1.

If the drag pipe 7 is inserted by means of boring hammer 1 into a trial bore (not shown) this is normally accomplished by means of the boring hammer 1 itself. If the friction between the drag pipe 7 and the surrounding earth of the boring is overly great such that the boring hammer 1 can no longer accomplish the driving operation by itself, a shearing force will be exerted on the free end of the drag pipe 7 by means of a hydraulic press and self-gripping tongs. Consequently, an axial force will be exerted opon the hammer 1 from the rear thereof, while the hammer 1 digs in at its forward end into the ground so that a reaction force is produced from the ground which is oppositely directed to the shearing or driving force applied through the drag pipe 7. This situation is indicated by arrows in FIG. 4.

Due to the forces which are produced, the bush 5 and the expander cone 4 move toward each other so that the clamping ring 9 will be pressed radially toward the inside of the apparatus by engagement of its inclined surfaces 12, 13 with the contact or mating surfaces 14, 15 of the expander cone 4 and the bush 5, respectively. As a result, the ring 9 is caused to become tightly frictionally engaged around the collar 2 of the hammer 1 and a frictional locking effect takes place. The hammer 1 is thus propped or supported toward the rear thereof such that an effective operation of the hammer 1 may be obtained.

If, after drilling of a trial bore, the hammer 1 is brought back in a protected manner within the drag pipe 7, the shearing force on the rear end of the drag pipe 7 is stopped. Since the hammer 1 is furthermore switched to return, the bush 5 and the expander cone 4 move into the position shown in FIG. 3 under the action of the resilient clamping ring 9 wherein they are axially spaced from each other. The ring 9 thus assumes a position whereby a greater inside diameter is provided so that the collar 2 of the hammer 1 is released and the hammer may thus be readily moved rearwardly through the drag pipe 7.

The clamping device according to the present invention need not necessarily be utilized with an earth displacement hammer and a drag pipe and it can also be utilized where similar problems such as those discussed above require solution. The clamping ring need not necessarily consist of resilient material, and the axial spreading position between the expander cone and the bush may also be achieved by arranging axially-acting compression springs between these elements.

While a specific embodiment of the invention has been shown and described in detail to illustrate the application of the inventive principles, it will be understood that the invention may be embodied otherwise without departing from such principles.

What is claimed is:

1. An earth boring assembly comprising hammer means for impacting through an earth formation to form a boring, expander cone means attached rearwardly of said hammer means, drag pipe means axially movably connected to said expander cone means to follow said hammer means into a boring, and clamping means interposed between said expander cone means and said drag pipe means operative to automatically effect frictional locking engagement between said hammer means and said drag pipe means when said expander cone means and said drag pipe means are moved toward each other and to automatically release said frictional engagement when they are moved away from each other.

2. An assembly according to claim 1 wherein said clamping means comprise an annular longitudinally slotted clamping ring.

3. An assembly according to claim 2 wherein said clamping ring is formed with a wedge shaped outer surface.

4. An assembly according to claim 2 wherein said clamping ring is formed of resilient material.

5. An assembly according to claim 2 wherein said clamping ring comprises a cylindrical inner surface and a pair of inclined outer surfaces which taper away from each other radially inwardly of said assembly.

6. An assembly according to claim 2 further including a bush fixedly secured with said drag pipe means, said clamping ring being arranged in a location between said expander cone means and said bush.

7. An assembly according to claim 6 wherein said clamping ring is formed with a pair of inclined outer surfaces and wherein said expander cone means and said bush each have surface means theron extending to engage said outer inclined surfaces of said clamping ring.

8. An assembly according to claim 7 wherein said expander cone means is shaped at its rearmost end facing said bush as a sleeve there being provided on said expander cone means a stop member projecting radially inwardly for engagement with said bush.

9. A device according to claim 8 wherein said bush includes an inwardly projecting stop member arranged in cooperative relationship with said stop member of said sleeve.

10. An assembly according to claim 9 wherein said bush includes an outer part displacably mounted on an offset circumferential surface of said sleeve.

11. An assembly according to claim 10 wherein said sleeve is provided with an annular recess designed as a blind bore, with a collar being provided on said hammer means with a diameter corresponding to the diameter of said annular recess.

12. An assembly according to claim 11 wherein said collar includes a rear circumferential edge facing said sleeve, said rear circumferential edge having a bevel configuration.

* * * * *